US006892706B2

(12) United States Patent
Kienzler et al.

(10) Patent No.: US 6,892,706 B2
(45) Date of Patent: May 17, 2005

(54) FUEL INJECTION DEVICE FOR INTERNAL COMBUSTION ENGINES, IN PARTICULAR A COMMON RAIL INJECTOR

(75) Inventors: Dieter Kienzler, Leonberg (DE); Kurt Frank, Schorndorf (DE); Thomas Kreutzer, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 154 days.

(21) Appl. No.: 10/296,152

(22) PCT Filed: Mar. 26, 2002

(86) PCT No.: PCT/DE02/01093

§ 371 (c)(1),
(2), (4) Date: Nov. 22, 2002

(87) PCT Pub. No.: WO02/077438

PCT Pub. Date: Oct. 3, 2002

(65) Prior Publication Data

US 2004/0020466 A1 Feb. 5, 2004

(30) Foreign Application Priority Data

Mar. 28, 2001 (DE) ..... 101 15 322

(51) Int. Cl.[7] ..... F02M 55/02
(52) U.S. Cl. ..... 123/468; 123/456
(58) Field of Search ..... 123/468, 469, 123/456, 514

(56) References Cited

U.S. PATENT DOCUMENTS

| | | | | | |
|---|---|---|---|---|---|
| 4,300,509 | A | | 11/1981 | Schechter | |
| 4,510,909 | A | * | 4/1985 | Elphick et al. | 123/470 |
| 4,790,055 | A | | 12/1988 | Raufeisen et al. | |
| 5,000,614 | A | * | 3/1991 | Walker et al. | 403/326 |
| 5,092,300 | A | * | 3/1992 | Imoehl et al. | 123/469 |
| 5,239,964 | A | * | 8/1993 | Diener et al. | 123/456 |

FOREIGN PATENT DOCUMENTS

| | | |
|---|---|---|
| DE | 37 00 687 A | 7/1987 |
| EP | 0 907 018 A | 4/1999 |
| WO | WO 98 27334 A | 6/1998 |
| WO | WO 98 44257 A | 10/1998 |

* cited by examiner

*Primary Examiner*—Mahmoud Gimie
(74) *Attorney, Agent, or Firm*—Ronald E. Greigg

(57) ABSTRACT

A common rail fuel injection device for internal combustion engines includes a housing, a high-pressure fuel connection, and a fuel return connection including a plug part for connection to a fuel return line. To make the fuel injection device easier to assemble, the fuel return connection includes a socket part, which is secured in fuelproof fashion in a fuel return opening in the housing and onto which the plug part is placed in fuelproof fashion.

16 Claims, 7 Drawing Sheets

FUEL INJECTION DEVICE FOR INTERNAL COMBUSTION ENGINES, IN PARTICULAR A COMMON RAIL INJECTOR

CROSS-REFERENCE TO RELATED APPLICATIONS

This application is a 35 USC 371 application of PCT/DE 02/01093 filed on Mar. 26, 2002.

BACKGROUND OF THE INVENTION

1. Field of the Invention

The present invention relates to a fuel injection device for internal combustion engines, in particular to a common rail injector, having a housing, having a high-pressure fuel connection, and having a fuel return connection that includes a plug part for connection to a fuel return line.

2. Description of the Prior Art

A known fuel injection device of the type with which this invention concerned is on the market. It is used in internal combustion engines for instance in which the fuel is injected directly into the combustion chamber of the engine. This can involve both Diesel engines and gasoline engines. The known fuel injection device is disposed directly on the cylinder head of the engine. Via a high-pressure pump and a fuel manifold, fuel is furnished to it under very high pressure.

Excessive fuel not delivered to the combustion chamber by the fuel injection device is carried away from the fuel injection device via a fuel return and reaches the fuel tank again, for instance, or the high-pressure pump. In the known fuel injection device, the connection of the return line is done on the axial end, remote from the cylinder head, of the fuel injection device. To that end, a plug part can be inserted into an opening in the housing of the fuel injection device. The fuel return line can then be connected in turn to this plug part.

In operation of the known fuel injection device, it has proved favorable to dispose the high-pressure fuel connection on the projecting end of the fuel injection device, which means that there is no longer any space at this point for the fuel return line. Moreover, because of the electrical connection, the injection device is seated deep in the cylinder head. As a result, known laterally insertable connections cannot be used.

It is therefore the object of the present invention to improve a fuel injection device of the type defined at the outset in such a way that it has an easily accessible return connection that can be adapted in a simple way to various installation situations.

This object is attained in that the fuel return connection includes a socket part, which is secured in fuelproof fashion in a fuel return opening in the housing and onto which the plug part is placed in fuelproof fashion.

SUMMARY OF THE INVENTION

The fuel injection device of the invention includes a two-part return connection, which comprises a socket part and a plug part. The presence of a separate socket part makes it possible to embody the return connection to suit individual installation conditions of a particular internal combustion engine, without having to make modifications in the overall fuel injection device. As a result, space is created for instance for the disposition of a high-pressure fuel connection on the projecting end of the fuel injection device.

Moreover, by means of an advantageous embodiment of the socket part, it is possible to make the return connection easier to both install and remove, and thus also to improve the operating safety of the fuel injection device.

Advantageous refinements of the fuel injection device of the invention are also disclosed. In a first refinement, the socket part and the plug part are both plastic injection-molded parts. Such parts are extremely economical and can be produced easily even with a complex geometry.

Furthermore, the fuel return opening is disposed laterally in the housing, and the socket part can have one portion toward the device and one portion toward the plug, whose longitudinal axes are at an angle to one another, preferably of approximately 90°, such that the longitudinal axis of the portion toward the plug extends essentially parallel to the longitudinal axis of the housing of the fuel injection device.

This refinement is especially preferred, since with it the return opening can be disposed at a more or less arbitrary point on the housing of the fuel injection device. By means of a suitable embodiment of the socket part, it is possible to shift the connection position in the axial direction and thus make it readily accessible to the user. Also by means of this refinement, it is possible to dispose the high-pressure fuel connection on the projecting end of the fuel injection device and at the same time to design the return connection in such a way that it can be embodied axially accessibly and above all in the axial direction of the housing of the fuel injection device.

Advantageously, the plug part has at least one stub for connection of a fuel return hose. Alternatively, however, two stubs for connecting two fuel return hoses can be provided. In that case, the plug part can be connected to a return ring line.

In a particularly preferred refinement of the fuel injection device of the invention, the plug part is secured on the socket part via a detent connection. This detent connection is easy to produce, readily withstands the usual operating loads, and is easy to open, for instance for inspection. The plug part can have at least one detent arm, which cooperates with at least one detent lug on the socket part.

For easy release of the detent connection, it is also proposed that the detent arm has an actuating portion, by which it can be actuated by hand in such a way that it comes free of the detent lug.

In order after assembly to assure in a simple way that the plug part is locked on the socket part in the desired way, it is proposed that the detent lug has a different color than at least the detent arm, and the detent arm is disposed such that the detent lug is visible from outside, in the locked state.

To make it easier to assemble the fuel return connection, it is also proposed that there is one protrusion on either the plug part or the socket part, and on the respectively other part, there is a groove that is complementary to the protrusion, and the protrusion and the groove cooperate such that by them, the angular position of the plug part relative to the socket part is unambiguously defined. As a result of this refinement, it becomes impossible to mount the plug part on the socket part in the wrong way.

In another refinement, a simple fastening of the socket part to the housing of the fuel injection device is disclosed. Accordingly, the socket part is secured inseparably in the fuel return opening of the housing by means of spray coating with plastic.

To prevent liquid plastic, during the injection molding operation, from soiling the region toward the plug of the socket part and thus making the later assembly of the fuel return connection more difficult, it is proposed that the socket part has a collar substantially orthogonal to the portion toward the plug and encompassing the portion toward the plug. During the injection molding operation, the injection tool can seal off the socket part at this collar.

If the fuel injection device is actuated electrically, an electrical connection device must be provided at some point. In that case, it is advantageous if the socket part and the electrical connection device are secured to the housing by the same spray coating. Both connection devices are thus encapsulated in the same injection molding compound and are securely held on the housing of the fuel injection device.

BRIEF DESCRIPTION OF THE DRAWINGS

Below, exemplary embodiments of the invention are explained in detail in conjunction with the accompanying drawings, in which.

DESCRIPTION OF THE PREFERRED EMBODIMENTS

Figure 1:
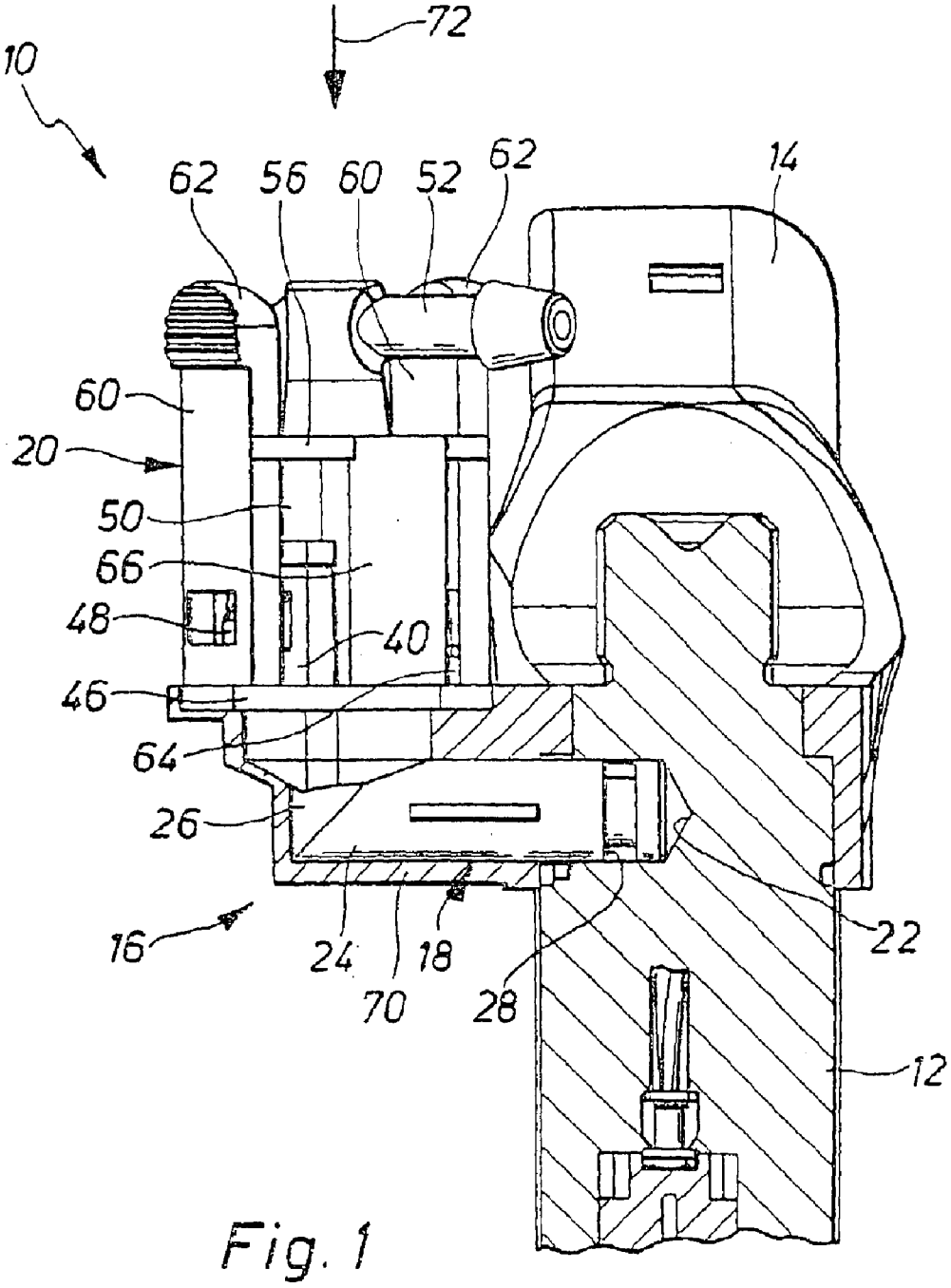
FIG. 1: a fragmentary longitudinal section through a first exemplary embodiment of a fuel injection device, with a socket part and a plug part.
Figure 2:
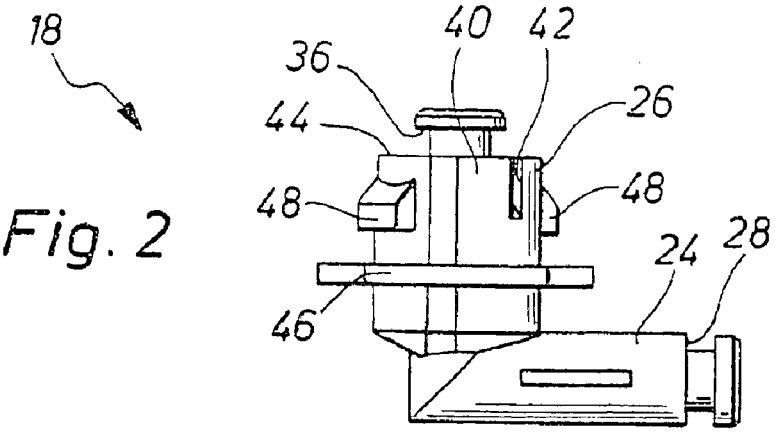
FIG. 2: a side view of the socket part of FIG. 1.
Figure 4:
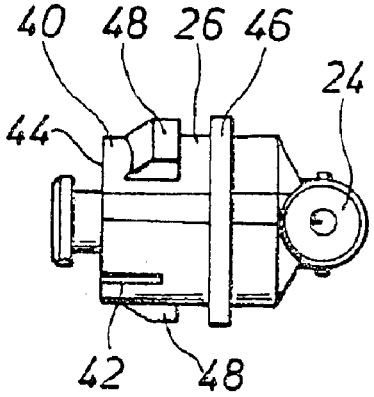
FIG. 4: a front elevation view of the socket part of FIG. 1.
Figure 3:
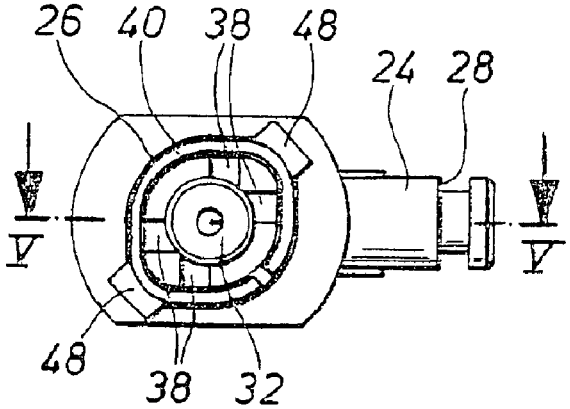
FIG. 3: a plan view of the socket part of FIG. 1.
Figure 5:
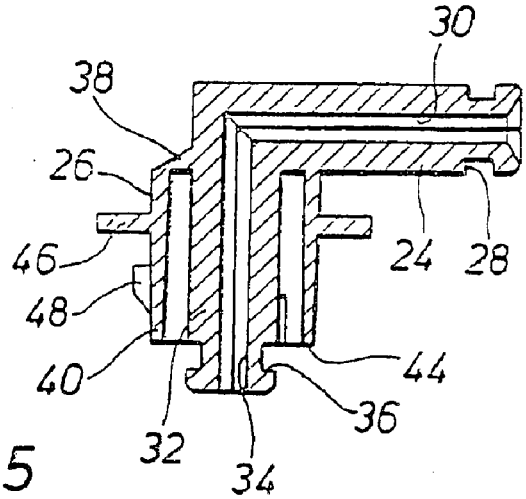
FIG. 5: a section taken along the line V—V of FIG. 3.
Figure 6:
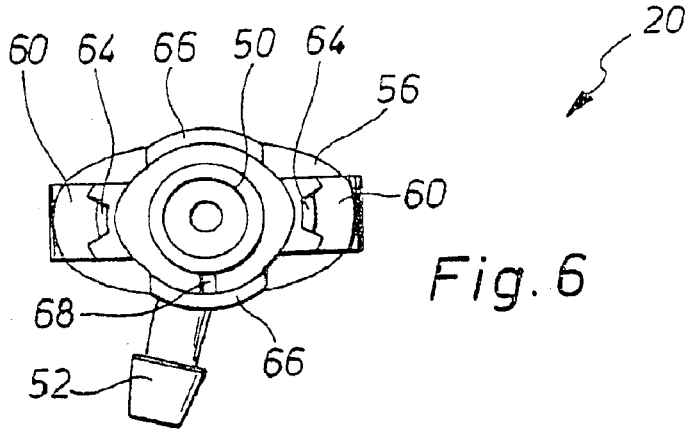
FIG. 6: a view from below of the plug part of FIG. 1.
Figure 7:
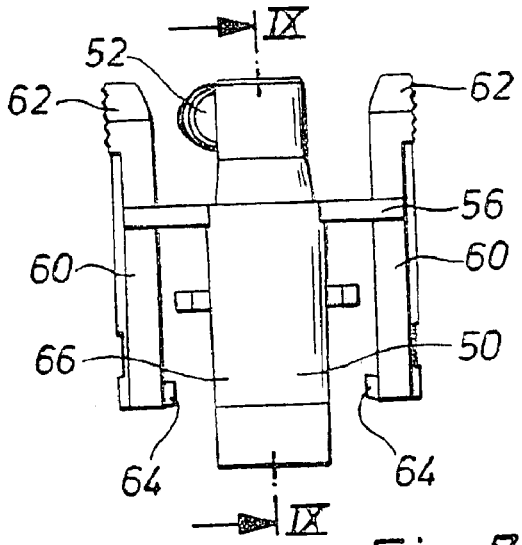
FIG. 7: a side view of the plug part of FIG. 1.
Figure 9:
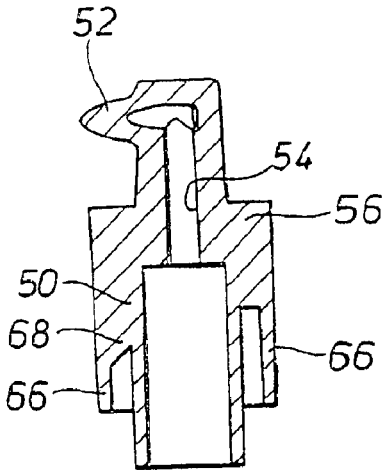
FIG. 9: a section taken along the line IX—IX of FIG. 7 through the plug part of FIG. 1.
Figure 8:
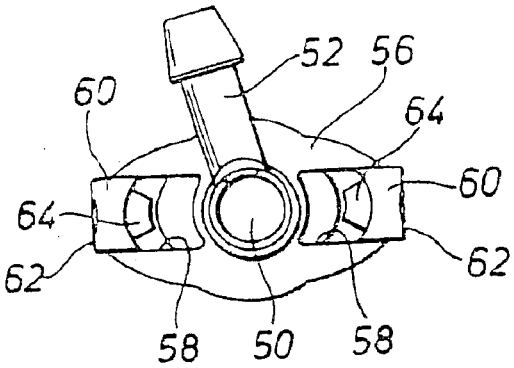
FIG. 8: a plan view on the plug part of FIG. 1.

In FIG. 1, a first exemplary embodiment of a fuel injection device is identified overall by reference numeral 10. The fuel injection device 10 shown is a common rail injector. It serves in an internal combustion engine to inject the fuel directly into the combustion chamber of the engine. Neither the engine nor the combustion chamber is shown in FIG. 1.

The injector 10 includes a housing 12, which on its lower end, not shown in FIG. 1, is secured to the cylinder head of the engine. On the end of the injector 10 projecting from the cylinder head of the engine, that is, the end that is visible in FIG. 1, there is a high-pressure fuel connection (not visible). An electrical connection 14 is also provided there, by way of which the injector 10 can be connected to an engine control unit (not shown).

Laterally in the upper region of the housing 12 is a fuel return connection 16, which comprises a socket part 18 and a plug part 20. The socket part 18 is inserted into a return opening 22 in the housing 12 of the injector 10. The longitudinal axis of the return opening 22, in the present exemplary embodiment, extends in the radial direction, that is, perpendicular to the longitudinal axis of the housing 12 of the injector 10 (but in an exemplary embodiment not shown, there can also be an offset between the longitudinal axis of the housing and the longitudinal axis of the return opening). Via the return opening 22, the fuel which was delivered to the injector via the high-pressure fuel connection but was not injected into the combustion chamber of the engine, is carried away from the injector 10.

The detailed embodiment of the socket part 18 will now be explained in conjunction with FIGS. 2–5:

The socket part 18 includes a portion 24 toward the injection device and a portion 26 toward the plug. The portion 24 toward the injection device is essentially cylindrically, and on its projecting end, somewhat spaced apart from it, it has an encompassing groove 28. An O-ring, not shown in FIGS. 2–5, is inserted into the groove 28. By this O-ring, the portion 24 toward the device of the socket part 18 is sealed off from the return opening 22, in the installed position shown in FIG. 1. A flow conduit 30 (see FIG. 5) extends in the interior of the portion 24 toward the injection device.

The portion 26 toward the plug is formed onto the end of the portion 24 toward the device projecting from the housing 12, in the installed position. It includes a likewise essentially cylindrical conduit housing 32, whose longitudinal axis extends at a right angle to the longitudinal axis of the portion 24 toward the device. The longitudinal axis of the portion 26 toward the plug is thus essentially parallel to the longitudinal axis of the housing 12 of the injector 10.

A flow conduit 34 extends in the interior of the conduit housing 32 and communicates fluidically with the flow conduit 30 in the portion 24 toward the device of the socket part 18. An encompassing groove 36 is also embodied in the portion 26 toward the plug, on its projecting end, spaced apart somewhat from it, and an O-ring, not shown in FIGS. 2–5, is placed in this groove. In the installed position, the sealing between the socket part 18 and the plug part 20 is effected by this O-ring.

Via four spacers 38, protruding approximately radially from the conduit housing 32, a guide ring 40 is formed onto the conduit housing 32. The center axis of the guide ring 40 and the center axis of the conduit housing 32 are in alignment with one another. The guide ring 40 has an approximately quadrilateral cross section with greatly rounded corners. The rounding of the diagonally opposed corners is the same in each case, while rounded corners next to them differ from one another. The guide ring 40 extends axially to a height just before the groove 36.

A narrow guide slot 42 extending in the axial direction is made in the guide ring 40 at one point. The guide slot 42 extends from the edge 44 of the guide ring 40 toward the plug, over approximately one-third of the length of the guide ring 40. On the end of the guide ring 40 toward the portion 24 toward the device, spaced apart somewhat from this end, an encompassing collar 46 is formed onto the guide ring 40. One detent lug 48 is formed onto each of two diametrically opposed regions of the guide ring 40. The detent lug 48 are colored bright green, while conversely the other parts of the socket part 15 are left grayish black.

The plug part 20 will now be explained in detail in conjunction with FIGS. 6–9:

It includes an approximately cylindrical base portion 50. Formed onto the upper end of base portion 50 is a radially protruding connection stub 52. A flow conduit 54 (FIG. 9) extends in the interior of the base portion 50. A fastening plate 56 is formed onto the upper region of the base portion 50. The plane of the fastening plate 56 is orthogonal to the longitudinal axis of the base portion 50. The fastening plate 56 has an elliptical basic outline overall. Recesses 58 are located in the region of the longer half-axes of the fastening plate 56.

In diametrically opposed end regions of the fastening plate 56, detent arms 60 are also provided, which extend parallel to the longitudinal axis of the base portion 50. The portion of the detent arms 60 located at the level of the connection stub 52 is embodied as an actuating portion 62. The portion of the detent arms 60 located at the level of the lower region of the base portion 50 in FIGS. 7 and 9 has one detent hook 64, oriented toward the base portion 50, on each of its projecting ends. The detent hook 64 is colored bright red, while all the other parts of the plug part 20 are kept grayish black.

Guide aprons 66 extend downward parallel to the base portion 50 from the side regions of the fastening plate 56, below the shorter half-axes. A riblike protrusion 68 is embodied between one of the two guide aprons 66 and the base portion 50.

The assembly of the injector 10 is done as follows:

First, the electrical connection 14 is placed at the top on the housing 12. Then the socket part 18 is inserted, with the portion 24 toward the injection device, into the return opening 22. This is done in such a way that the portion 26 toward the plug of the socket part 18 extends upward, in terms of FIG. 1, parallel to the longitudinal axis of the housing 12 of the injector 10. In an injection molding tool, the electrical connection 14 and the socket part 18 are now spray-coated with plastic compound 70. The injection-molding tool is sealed off from the outside by the collar 46, among other provisions. By means of the plastic spray coating 70, the socket part 18 is fastened securely to the housing 12.

After the injector 10 has been installed in the engine, the fuel return connection 16, among other elements, is attached. This is done first by slipping the plug part 20 onto the socket part 18 in the axial direction, as indicated by the arrow 72. For doing so, the user firmly holds the plug part by the actuating portions 62. The user guides the plug part 20 in such a way that the protrusion 68 between the guide aprons 66 and the base portion 50 of the plug part engages the guide slot 42 in the portion 26 toward the plug of the socket part 18.

Thus the protrusion 68 and the guide slot 42 assure that the plug part 20 is secured in a defined angular position relative to the socket part 18. During the process of sliding the plug part on, the guide aprons 66 slide along the guide ring 40. Because of the geometric shape of the guide ring 40, with the differently rounded corners, and because of the guide aprons 66, once again an unambiguous angular position of the plug part 20 relative to the socket part 18 is also defined. In addition, the plug part 20 is centered relative to the socket part 18 during the process of being slipped on, by means of the guide aprons 66 and the guide ring 40.

During the process of sliding the plug part on, the detent hooks 64 slide on the detent arms 60 of the plug part 20 over the detent lugs 48 on the socket part 18. From the standpoint of the user, initially only the red detent hooks 64 are then visible. As a result, the detent hooks 64 are pressed elastically radially outward on the detent arms 60. At the end of the slipping-on operation, the detent hooks 64 on the ends of the detent arms 60 snap radially inward and rest with an axial retaining face (not shown) on the corresponding detent lugs 48 of the socket part 18. In this way, the plug part 20 is securely fixed to the socket part 18. The red detent hooks 64 are now concealed to the view of the user by the green detent lugs 48. This gives the user visual feedback about the connection that has been made.

To release the plug part 20 from the socket part 18, the user presses the actuating portions 62 of the detent arms 60 radially inward. This moves the detent hooks 64 radially outward, thus releasing them from the detent lugs 48. The user can now pull the plug part 20 off again from the socket part 18.

A leakage hose (not shown) is then slipped onto the connection stub 52. By way of this hose, excess fuel can be returned.

Figure 10:
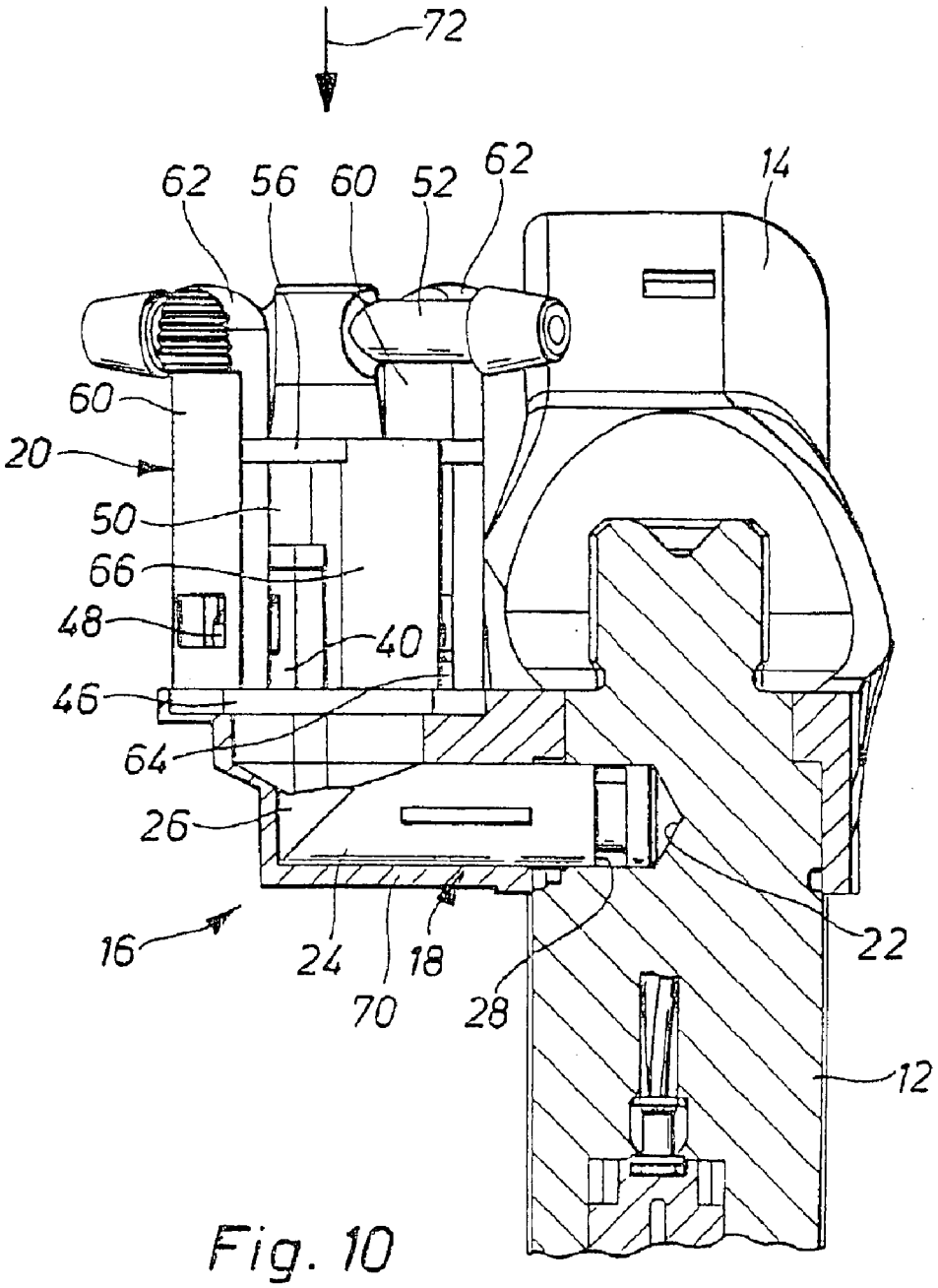
FIG. 10: a fragmentary longitudinal section through a second exemplary embodiment of a fuel injection device.

In FIG. 10, a second exemplary embodiment of an injector 10 is shown. Parts and elements that have equivalent functions to parts and elements of the exemplary embodiment described above are identified by the same reference numerals. They will not be explained again in detail.

In a distinction from the injector 10 described in FIGS. 1–9, the injector 10 shown in FIG. 10 has a plug part 20 which includes two connection stubs 52, pointing diametrically away from one another, on the base portion 50. In this way, it is possible to connect the injector 10 to an annular leakage line (not shown).

Figure 11:
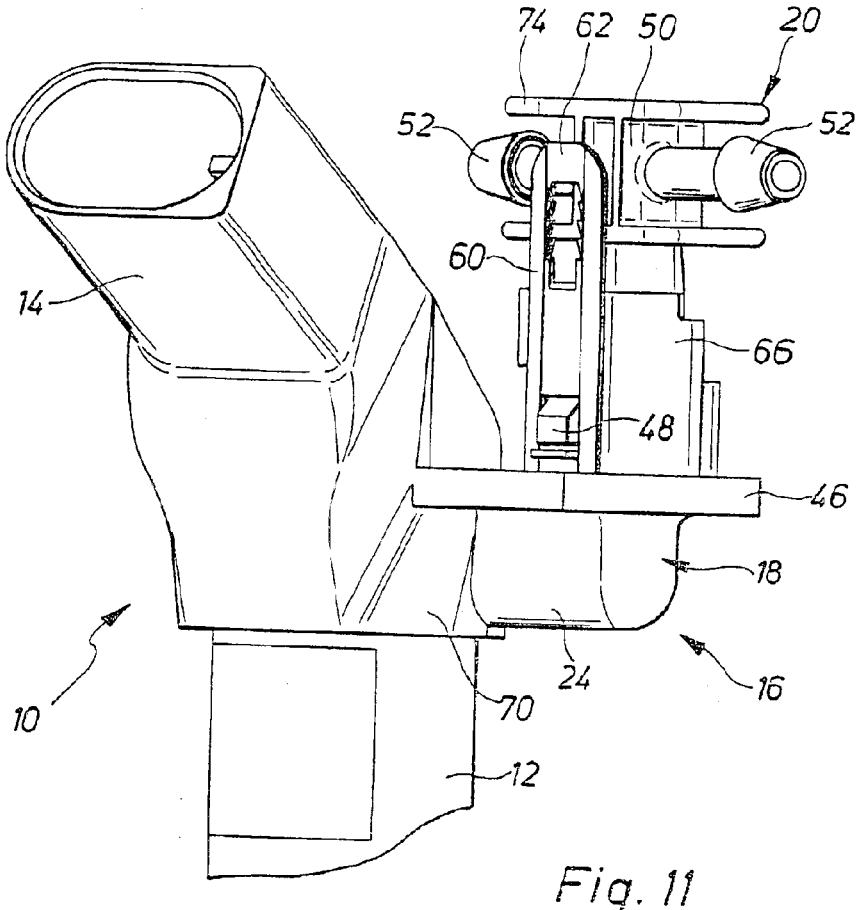
FIG. 11: a perspective view of a third exemplary embodiment of a fuel injection device.
Figure 12:
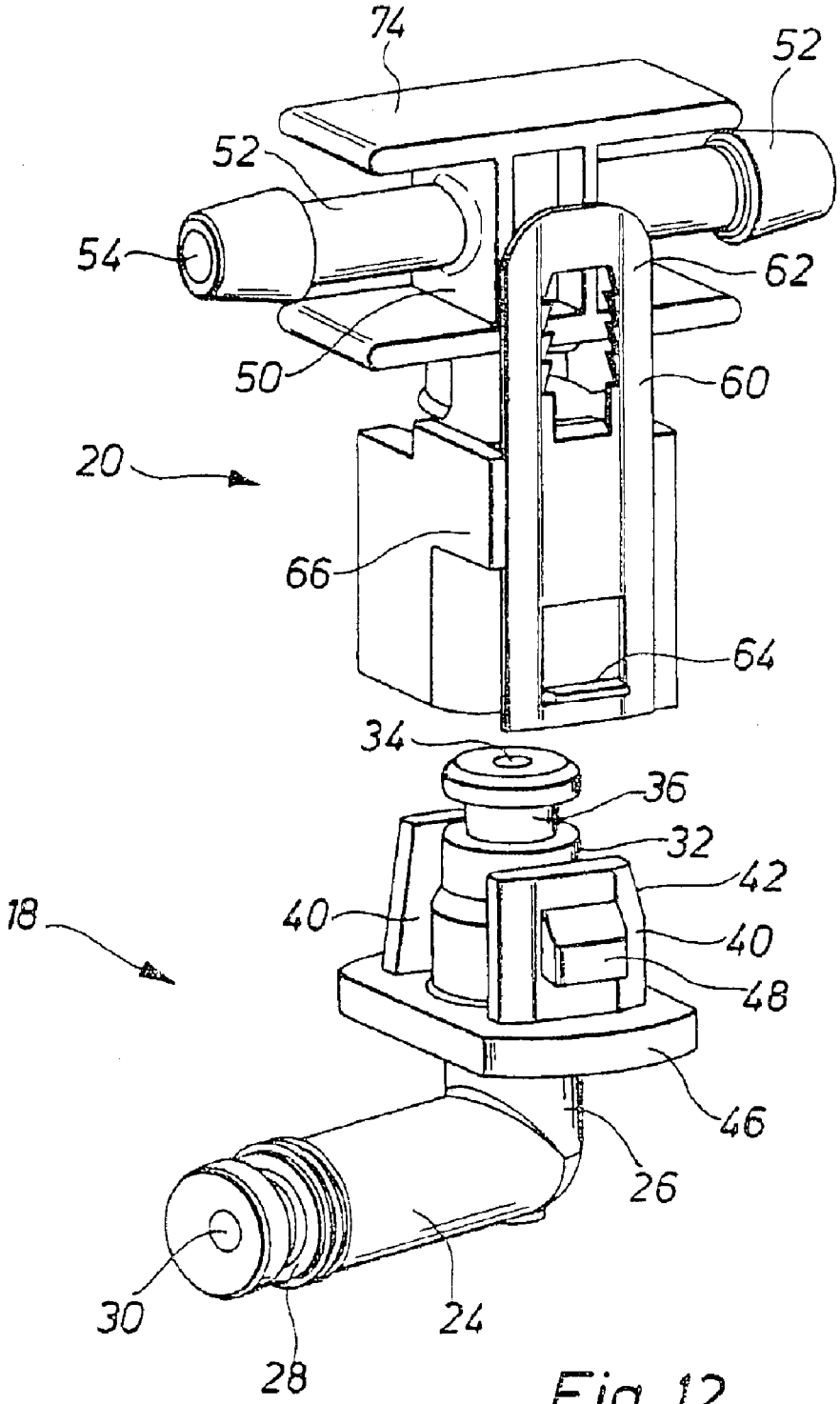
FIG. 12: a perspective view of the plug and the socket of the fuel injection device of FIG. 11, in the uninstalled state.
Figure 13:
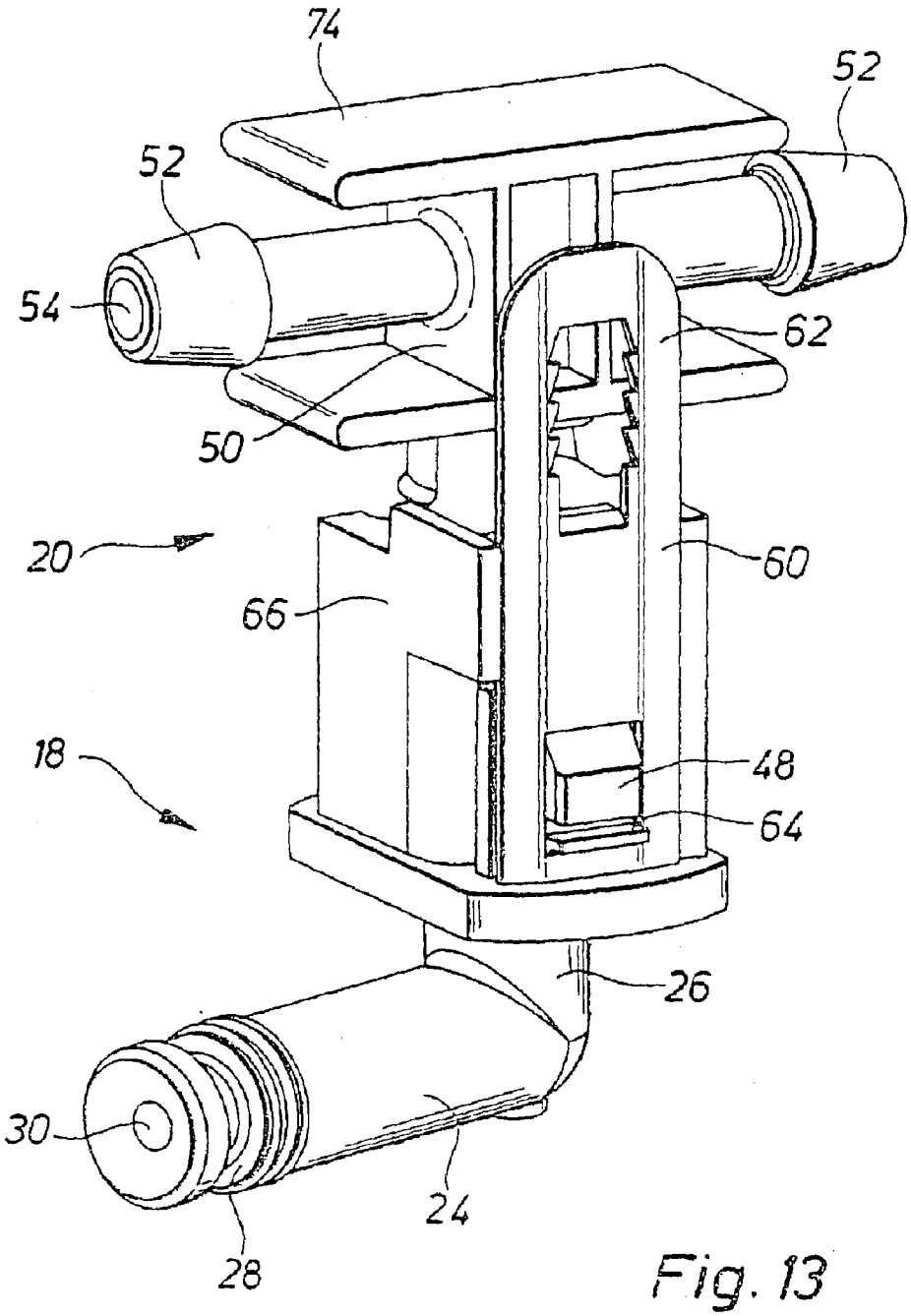
FIG. 13: a view similar to FIG. 12, in the installed state.

In FIGS. 11–13, a third exemplary embodiment of a fuel injection device 10 is shown. Parts and elements that have equivalent functions to parts and elements of the exemplary embodiments described above are identified by the same reference numerals. They are not explained again in detail.

Unlike the exemplary embodiments described above, in this exemplary embodiment there is only a single detent arm 60 on the plug part 20. Moreover, this detent arm 60 is not produced integrally with the plug part 20 but instead comprises a separate sheet-metal part, which is clipped into the plug part 20. For better manipulation, a plurality of retaining plates 74 are formed onto the projecting end of the plug part 20 and furthermore serve to protect the connection stubs 22.

The foregoing relates to preferred exemplary embodiment of the invention, it being understood that other variants and embodiments thereof are possible within the spirit and scope of the invention, the latter being defined by the appended claims.

We claim:

1. A common rail fuel injection device (10) for internal combustion engines, comprising a housing (12), a high-pressure fuel connection, and a fuel return connection (16) that includes a plug part (20) for connection to a fuel return line, the fuel return connection (16) including a socket part (18), which is secured in fuelproof fashion in a fuel return opening (22) in the housing (12) and onto which the plug part (20) is placed in fuelproof fashion, wherein the fuel return opening (22) is disposed laterally in the housing (12), wherein the socket part (18) comprises a first portion (24) toward the device and a second portion (26) toward the plug, the longitudinal axes of the first and second portions (24, 26) are at an angle to one another, preferably of approximately 90°, and wherein the longitudinal axis of the portion (26) toward the plug extends essentially parallel to the longitudinal axis of the housing (12) of the fuel injection device (10).

2. The fuel injection device (10) of claim 1, wherein the socket part (18) and the plug part (20) are each a plastic injection-molded part.

3. The fuel injection device (10) of claim 1, wherein the plug part (20) comprises at least one stub (52) for connection of a fuel return hose.

4. The fuel injection device (10) of claim 2, wherein the plug part (20) comprises at least one stub (52) for connection of a fuel return hose.

5. The fuel injection device (10) of claim 3, wherein the plug part (20) has two stubs for connecting two fuel return hoses.

6. The fuel injection device (10) of claim 4, wherein the plug part (20) has two stubs for connecting two fuel return hoses.

7. The fuel injection device (10) of claim 1, wherein the plug part (20) is secured on the socket part (18) via a detent connection (48, 64).

8. The fuel injection device (10) of claim 7, wherein the plug part (20) has at least one detent arm (60), which cooperates with at least one detent lug (48) on the socket part (18).

9. The fuel injection device (10) of claim 8, wherein the detent arm (60) has an actuating portion (62), by which it can be actuated by hand in such a way that it comes free of the detent lug (48).

10. The fuel injection device (10) of claim 8, wherein the detent lug (48) has a different color than at least the detent arm (60), and wherein the detent arm (60) is disposed such that the detent lug (48) is visible from outside, in the locked state.

11. The fuel injection device (10) of claim 9, wherein the detent lug (48) has a different color than at least the detent arm (60), and wherein the detent arm (60) is disposed such that the detent lug (48) is visible from outside, in the locked state.

12. The fuel injection device (10) of claim 1, further comprising one protrusion (68) on either the plug part (20) or the socket part (18), and a groove (42) on the respectively other part (18, 20), the groove being complementary to the protrusion, and the protrusion (68) and the groove (42) cooperating such that by them, the angular position of the plug part (20) relative to the socket part (18) is unambiguously defined.

13. The fuel injection device (10) of claim 1, wherein the socket part (18) is secured inseparably in the fuel return opening (22) of the housing (12) by means of spray coating.

14. The fuel injection device (10) of claim 1, wherein the socket part (18) has a collar (46) substantially orthogonal to the portion (26) toward the plug and encompassing the portion (26) toward the plug.

15. The fuel injection device (10) of claim 13, further comprising an electrical connection device (14), and the socket part (18) and the electrical connection device (14) being secured to the housing (12) by the same spray coating (70).

16. The fuel injection device (10) of claim 14, further comprising an electrical connection device (14), and the socket part (18) and the electrical connection device (14) being secured to the housing (12) by the same spray coating (70).

* * * * *

UNITED STATES PATENT AND TRADEMARK OFFICE

CERTIFICATE OF CORRECTION

PATENT NO. : 6,892,706 B2
DATED : May 17, 2005
INVENTOR(S) : Dieter Kienzler et al.

It is certified that error appears in the above-identified patent and that said Letters Patent is hereby corrected as shown below:

Title page,
Item [86] should read as follows, -- [86] PCT No.: PCT/DE02/01093
371 (c)(1),
(2), (4) Date: March 23, 2003 --

Signed and Sealed this

Nineteenth Day of July, 2005

JON W. DUDAS
*Director of the United States Patent and Trademark Office*